US006405460B1

(12) United States Patent
Whitmire et al.

(10) Patent No.: US 6,405,460 B1
(45) Date of Patent: Jun. 18, 2002

(54) EXCAVATOR BUCKET ATTACHMENT

(75) Inventors: James A. Whitmire, Florien; David Abshire, Westlake; Gavin Abshire, Lake Charles, all of LA (US)

(73) Assignee: James Whitmire, Westlake, LA (US)

( * ) Notice: Subject to any disclaimer, the term of this patent is extended or adjusted under 35 U.S.C. 154(b) by 7 days.

(21) Appl. No.: 09/843,849

(22) Filed: Jun. 21, 2001

(51) Int. Cl.[7] ..... F02F 3/96
(52) U.S. Cl. ..... 37/405
(58) Field of Search ..... 37/403, 404, 405, 37/406, 407, 466, 468, 903, 444, 450; 414/724, 912; 172/772, 773, 701.3

(56) References Cited

U.S. PATENT DOCUMENTS 4,125,952 A * 11/1978 Jennings ..... 37/403
4,242,035 A * 12/1980 Hornstein ..... 414/724
5,142,799 A * 9/1992 Wood ..... 37/403
5,273,375 A * 12/1993 Plourde ..... 404/118
6,074,160 A * 6/2000 Brumbaugh et al. ..... 414/704
6,085,447 A * 7/2000 Rose ..... 37/403
6,098,321 A * 8/2000 Logan ..... 37/409

* cited by examiner

*Primary Examiner*—Robert E. Pezzuto

(57) ABSTRACT

This invention, which by design attaches to an excavator bucket (16), latches locking hook arms (10) on the inside of the top of the excavator bucket (16). The invention is comprised of a plurality of specially designed hook arms (10) and at least one specially designed fork (14) both of which are welded in specific locations to opposite sides of a plate (12). Due to the manufacture of different styles, types, and sizes of excavator buckets and construction materials, this invention can be specifically fabricated relative to the intended excavator bucket (16) or construction task.

1 Claim, 9 Drawing Sheets

EXCAVATOR BUCKET ATTACHMENT

BACKGROUND—DESCRIPTION OF PRIOR ART

One major element of the construction industry is handling and installing RCP (reinforced concrete pipe) below grade (ground level) in a trench. Prior art that could be found near to this invention (FIG. 9) consists of a process involving a short cable, sometimes called a choker (24), of sufficient strength and design, attached to an excavator bucket's pad-eye (28) by means of a shackle (26). This choker (24) is then fed down through a hole (34), about three inches in diameter, which is cast in the wall of the RCP (18). To the cable's free end, now inside the pipe, a steel cup (30) is affixed to the cable end (32) to permit lifting of RCP. Once pipe is in position (FIG. 9), cable (36) and winch (38) are used to complete meshing the ends of the RCP (18). After process is finished and all parts for handling RCP are removed and set aside, excavator can then resume trenching or other jobs.

This process takes several pieces of equipment, three to four-workers (depending on job specifics), and about thirty minutes to secure one eight-foot joint of RCP in the trench. Another important consideration is the part that a winch and cable play in the final installation process of the RCP. Certainly this adds more time, labor, and safety concerns to a job, many of which can be eliminated with the use of this invention.

Quite possibly a fork lift could be considered some aspect of prior art, but our invention functions above and beyond the limitations of a fork lift in its ability to work below grade. Fork lifting devices have been used for some time, but this invention uses a unique attachment design particular to an excavator bucket, which allows for use above, at, and below grade.

Backhoes and other similar excavator machines that employ excavating buckets have been fitted with mechanical attachments. One example of a type of prior art is U.S. Pat. No. 5,553,408 issued to Townsend in 1996, which is also named an excavator bucket attachment. This device mounts in an entirely different manner and accomplishes totally different tasks than our invention. It is a thumb-like apparatus, which exhibits claw-like, clamping ability. Our research uncovered several other examples of devices which attach to excavator buckets, none of which are similar in design or function to our invention.

SUMMARY

In accordance with the present invention, the construction equipment device, titled an excavator bucket attachment, is comprised of a set of two specially designed hooking members, referred to as hook arms, and a set of two specially designed support members, referred to as forks, both of which are welded in specific locations to opposite sides of a plate (FIG. 3).

OBJECTS AND ADVANTAGES

Accordingly, several objects and advantages of this invention are:

(a) to provide a method for handling RCP (reinforced concrete pipe) or other construction materials above, at, and below grade (b) to provide a more cost-effective method for handling RCP (c) to reduce time and manpower involved in handling RCP (d) to provide a safer means of handling RCP (e) to provide a method for handling RCP with less machinery thereby producing positive environmental impacts (less emissions, less fuel consumption, etc.)

Further objects and advantages of our invention will become apparent from the drawing and ensuing description.

DRAWING FIGURES

FIG. 9 shows an example of prior a.

REFERENCE NUMERALS IN DRAWING

| | |
|---|---|
| 10 | hook arms |
| 12 | plate |
| 14 | forks |
| 16 | excavator bucket |
| 18 | RCP (reinforced concrete pipe) |
| 20 | excavator |
| 22 | wood bumper |
| 24 | choker |
| 26 | shackle |
| 28 | pad eye |
| 30 | cup |
| 32 | cable end |
| 34 | hole in RCP |
| 36 | cable puller |
| 38 | electric winch |

DETAILED DESCRIPTION—PREFERRED EMBODIMENT

Figure 1:
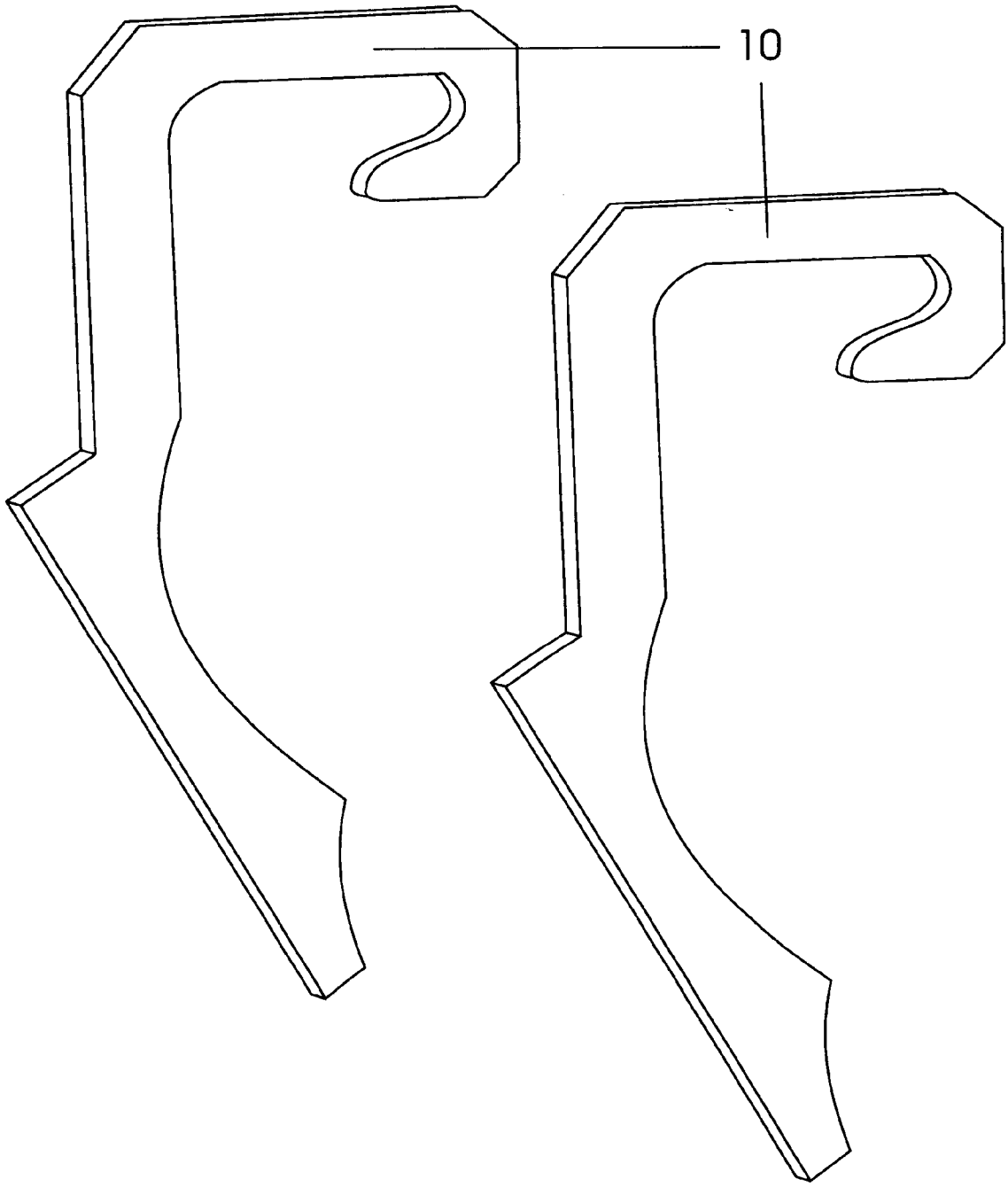
FIG. 1 shows the set of two specifically designed hook arms.
Figure 2:
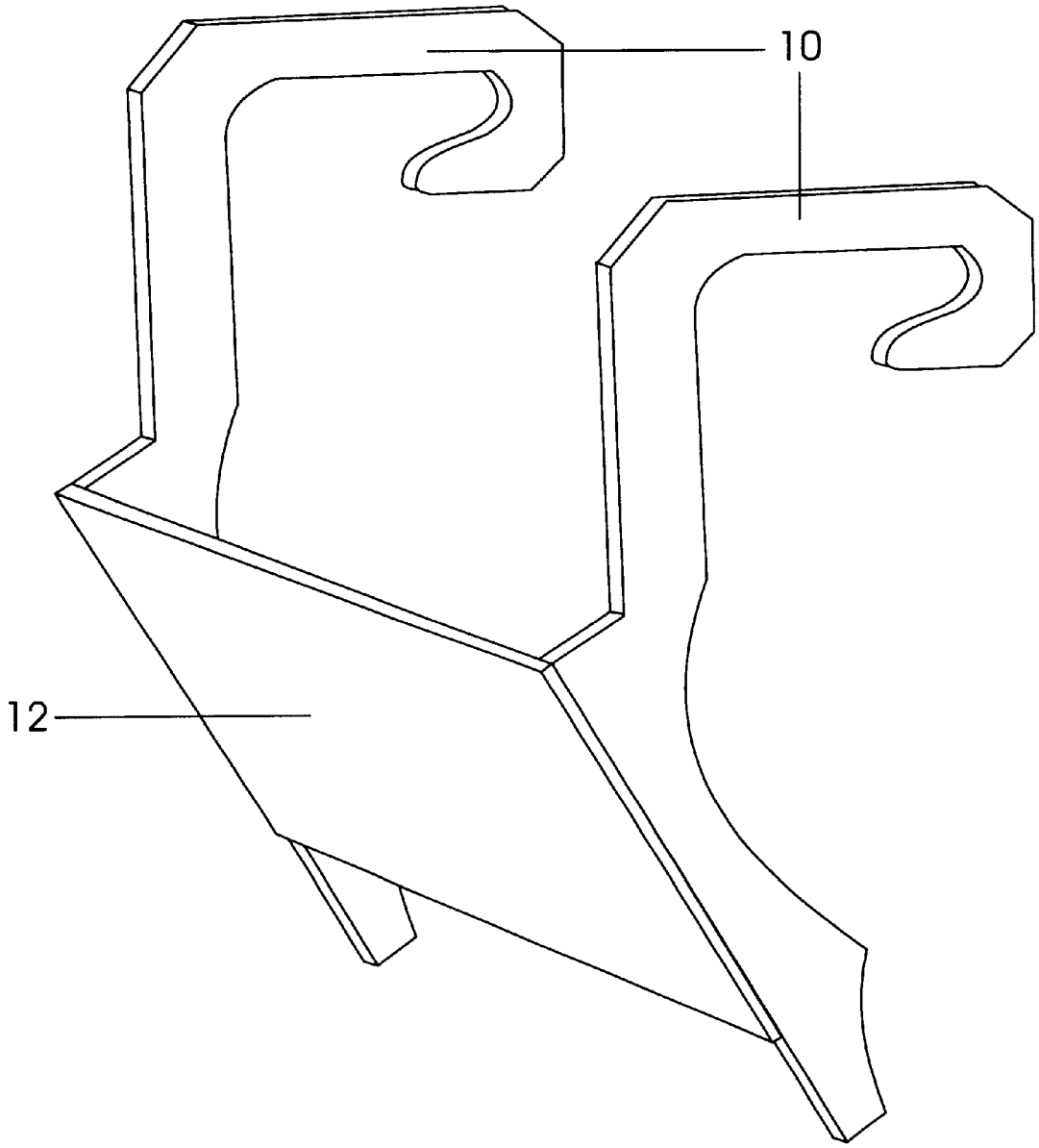
FIG. 2 shows the set of two specifically designed hook arms welded to a plate.
Figure 3:
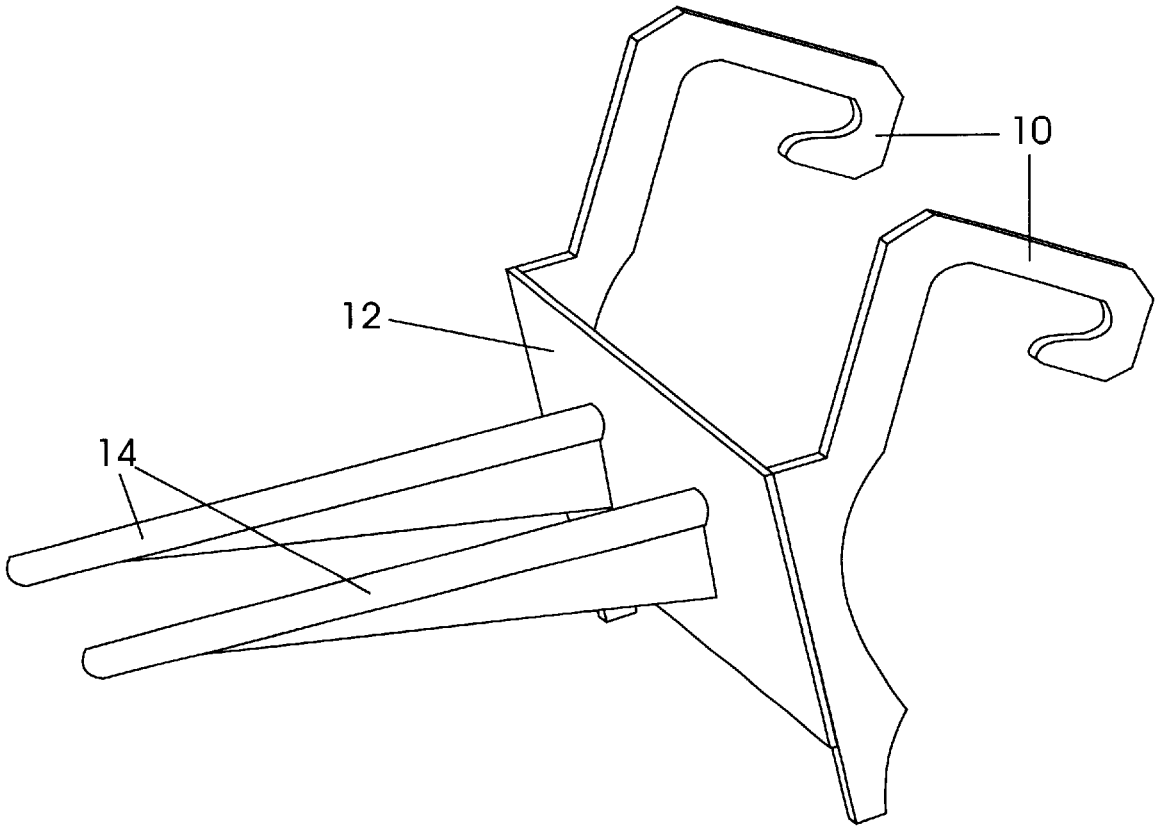
FIG. 3 shows completed excavator bucket attachment comprised of hook arms and forks welded in position on opposite sides of plate.
Figure 4:
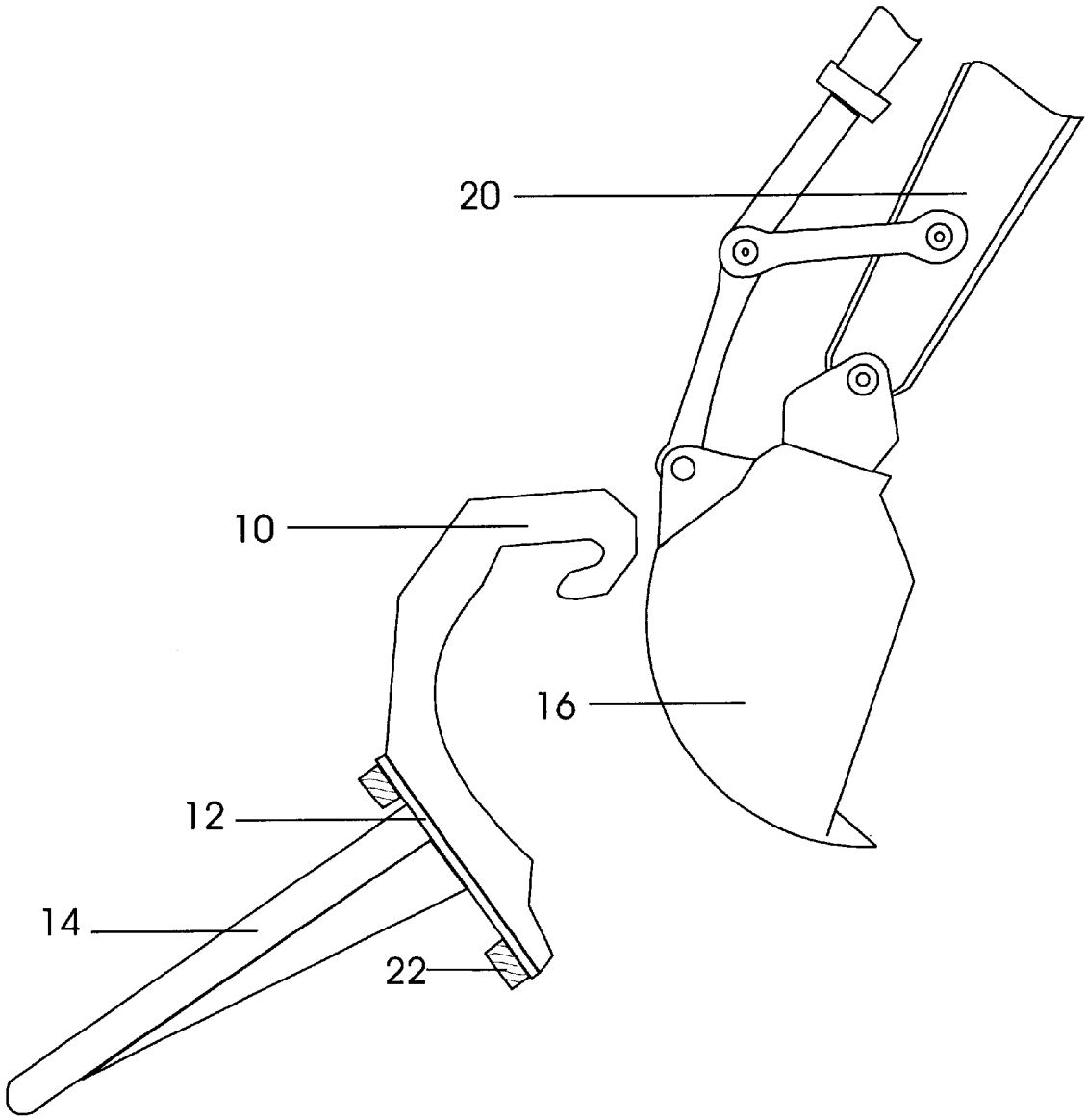
FIG. 4 shows an example diagram of a basic excavator bucket with excavator bucket attachment before latching process.
Figure 5A:
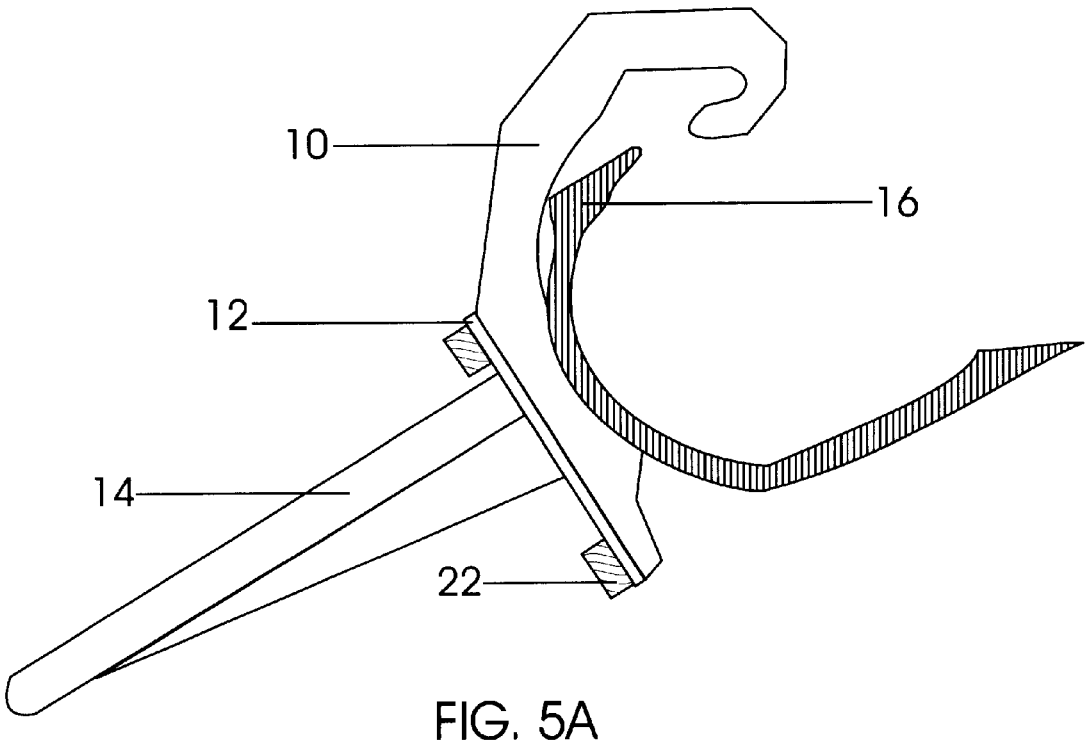
FIG. 5A shows a profile view of the process of latching the excavator bucket attachment to an excavator bucket.
Figure 5B:
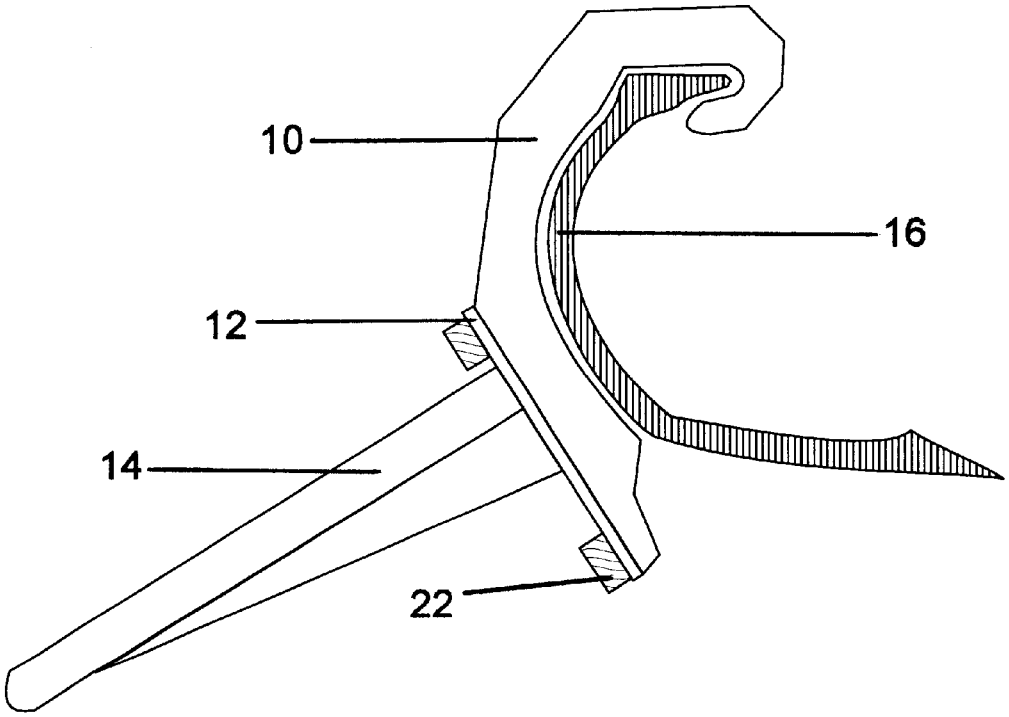
FIG. 5B shows a profile view of completed latching process.

This invention is a new and improved way to handle and install RCP (reinforced concrete pipe) or other construction materials. It is made of steel plate and heavy wall steel pipe, which are necessary for strength and durability. Steel plate material is cut into proper shape to create two hook arms (FIGS. 1–10) of a design to fit intended excavator bucket. Next, steel plate material is cut into proper shape to create a plate (FIGS. 2–12), which is then welded to hook arms with hooks facing away from plate (FIG. 2). Once properly welded in place, plate (FIGS. 3–12) becomes a platform for the forks (FIGS. 3–14), which are formed from heavy wall steel pipe. Forks are then welded properly and in position on plate (12) for handling varying sizes and weights of RCP (FIG. 3).

As shown in FIGS. 6–22 and FIGS. 8–22, wood or some other material can be used as a cushion to prevent metal-to-concrete contact to avoid chipping the RCP.

ALTERNATIVE EMBODIMENTS

Figure 7:
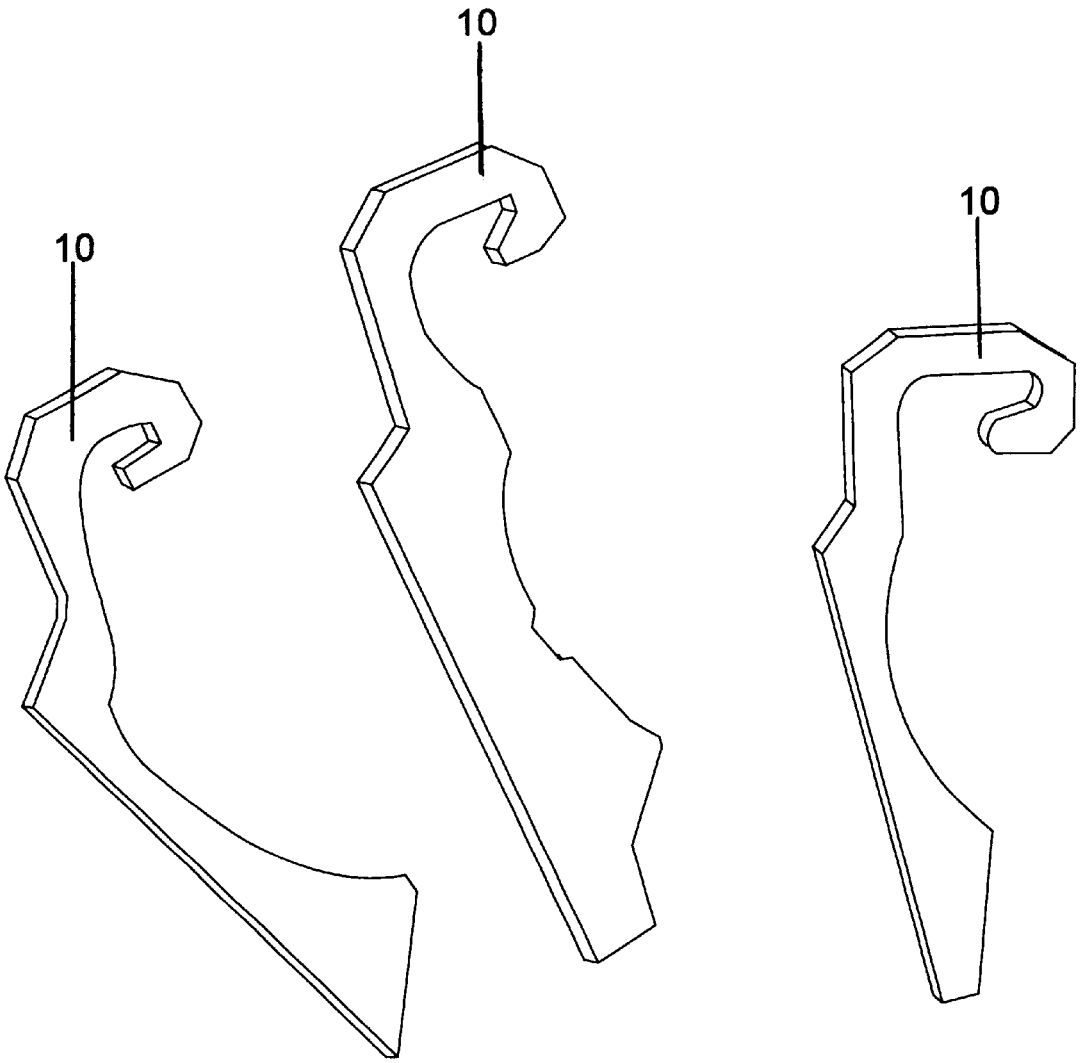
FIG. 7 shows three examples of altered designs of hook arms to fit different styles or shapes of manufacturer's excavator buckets.
Figure 8:
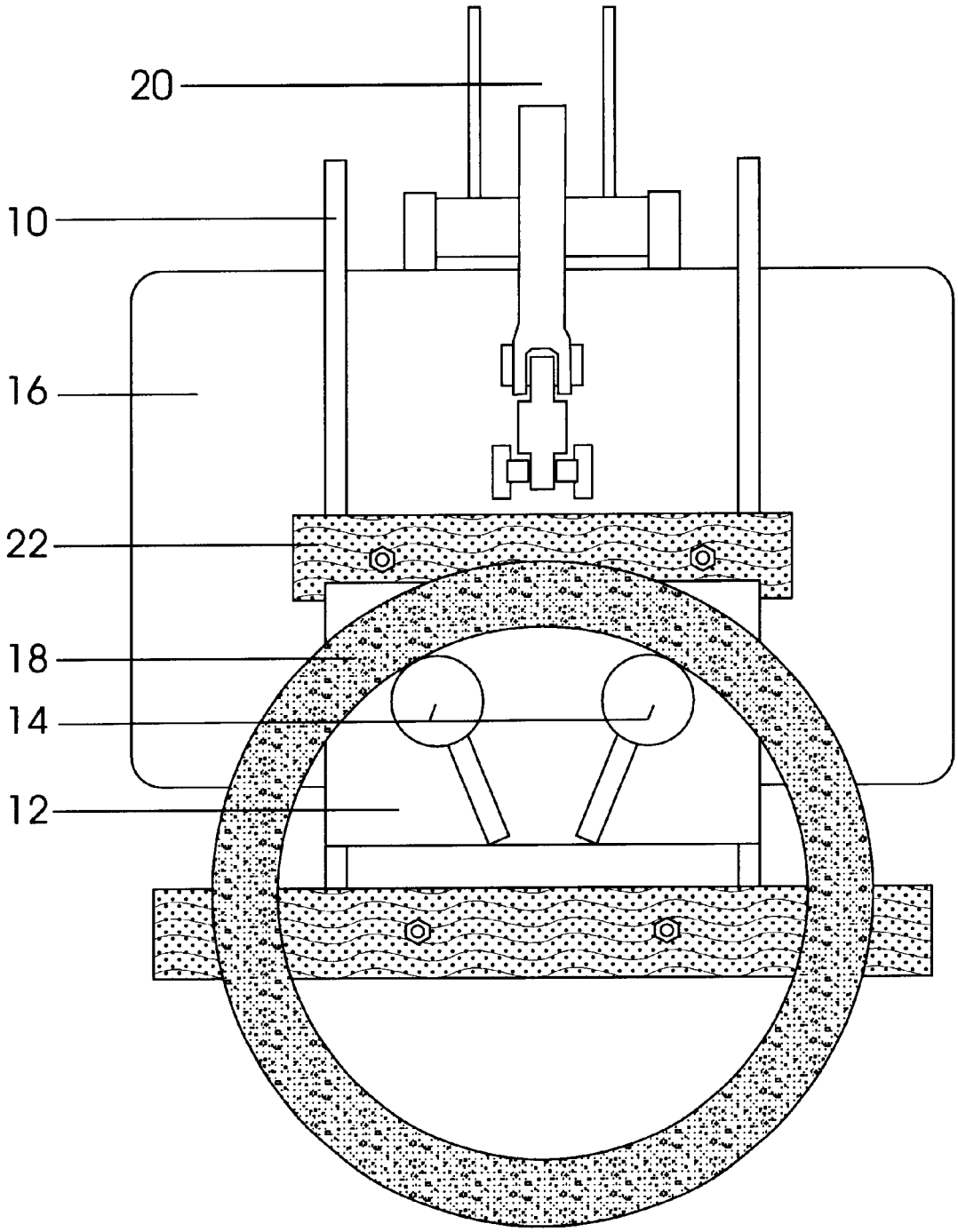
FIG. 8 shows an end view of RCP in lifted position.
Figure 9:
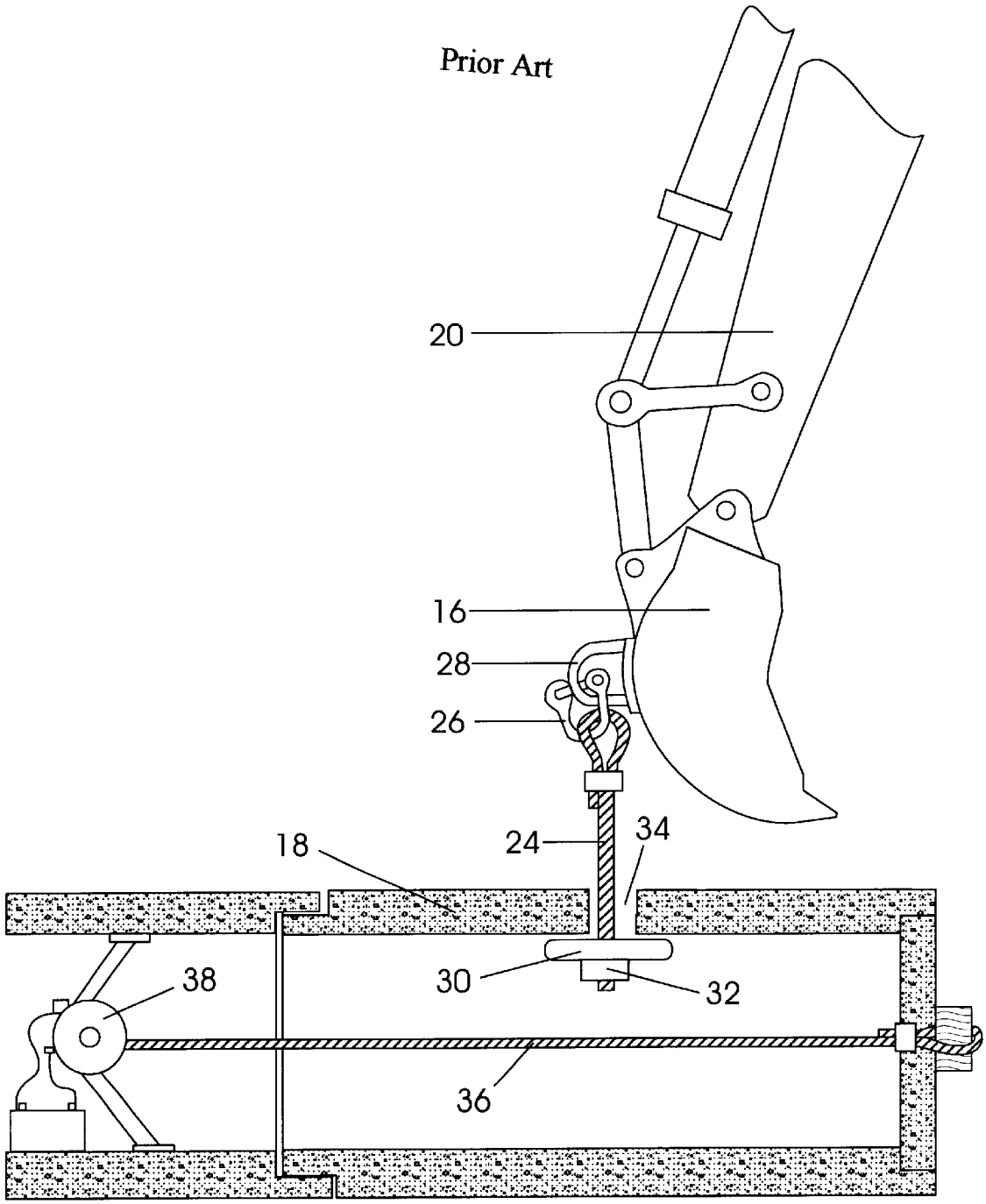

Changes in size and shape of this invention may be made to fit different shapes and sizes of manufacturer's excavator buckets, RCP (reinforced concrete pipe), or other construction materials. The hook arms are the principle element of this invention. Although their basic design remains the same, their shape may be altered to fit any particular excavator bucket (FIG. 7). In some cases, size or number of forks may be altered to fit requirements of smaller or larger RCP (reinforced concrete pipe) or other construction materials.

OPERATION

Figure 6:
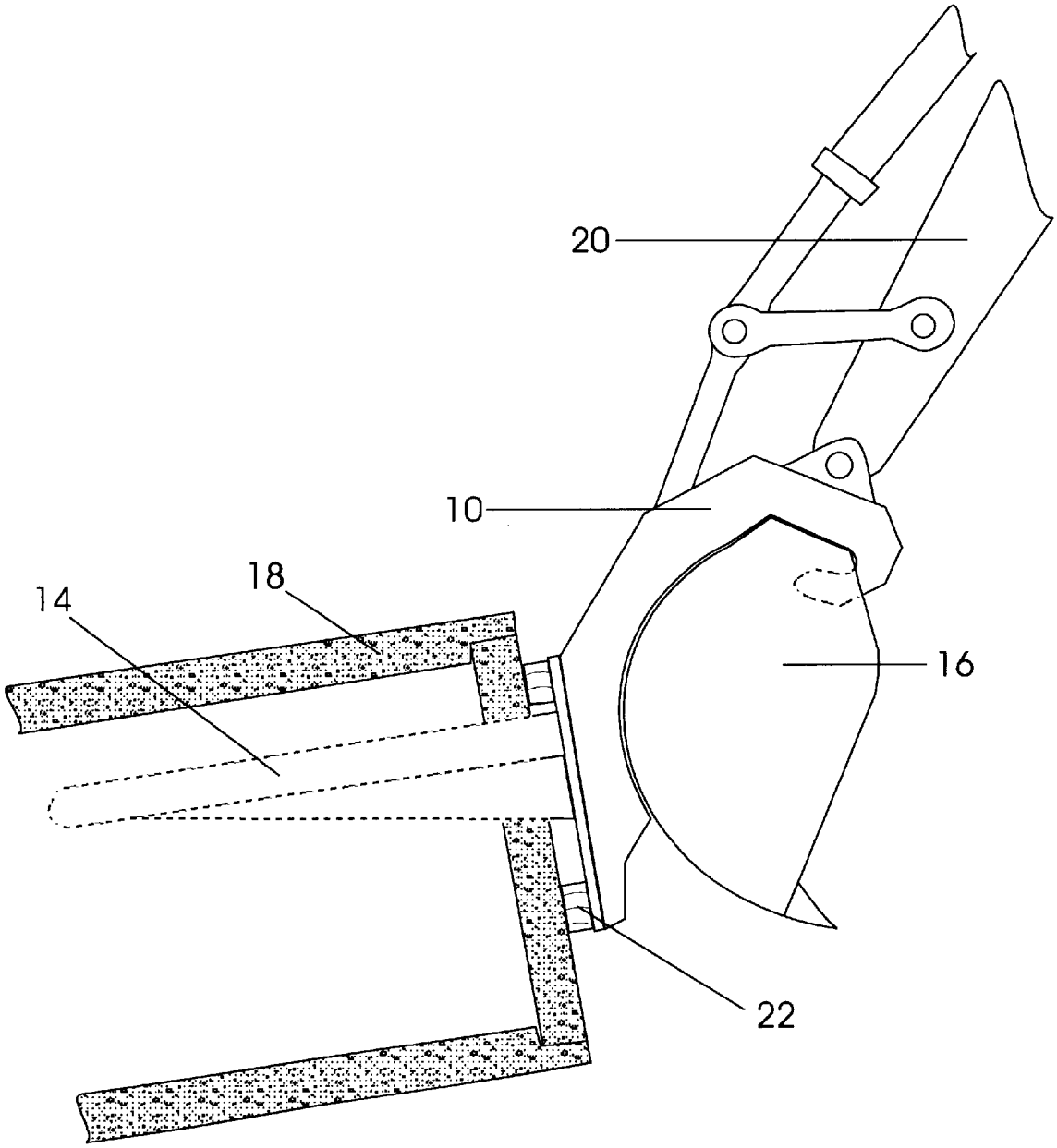
FIG. 6 shows the excavator bucket attachment in use handling RCP (reinforced concrete pipe).

The method for using this invention in its preferred or alternative embodiments is the same and involves only excavator bucket attachment, excavator, and excavator operator. The entire process can be completed with no additional assistance. Steps in the process are as follows:

1. Operator moves excavator into position facing the excavator bucket attachment,
2. Operator manipulates bucket into position (FIG. 4) so that the latching of excavator bucket attachment is made when hook arms are in line over the back of the excavator bucket (FIG. 5A).
3. Excavator bucket is then lifted and curled outward away from excavator.
4. Excavator bucket attachment is now latched and in place (FIG. 5B) and becomes a working part of the excavator.
5. Operator moves excavator into position, and inserts forks in RCP (reinforced concrete pipe) to a depth reaching the plate (FIG. 6). Then RCP can be lifted and/or moved to desired location. Excavator bucket attachment can be used to unload RCP delivery trucks, and place pipe along the length of a trench area, in trench at depth and grade, or carried to any desired area within job site.
6. Excavator bucket attachment can be removed from bucket by lowering to grade and reversing the latching process (steps 1–4).
7. Excavator can now resume trenching or other jobs.

CONCLUSION, RAMIFICATIONS, AND SCOPE

It is obvious that the excavator bucket attachment of this invention can be used to handle RCP (reinforced concrete pipe) or other construction materials more safely and in a time and labor-saving manner. It can be attached to and removed from the excavator bucket quickly and easily, without limiting the ability of the excavator to be used for other jobs. Although the descriptions above contain several specificities, these should not be construed as limiting the scope of the invention, but merely providing examples of some present embodiments of this invention. Variations are possible. For example, the excavator bucket attachment may be better suited to a specific job with only one fork rather than a plurality of forks. Accordingly, the scope of the invention should be determined not by the embodiments illustrated, but by the claims.

We claim:

1. A bucket attachment in combination with an excavator bucket, the bucket comprising an upper front edge and lower leading front edge, a top wall, a bottom wall, two opposing side walls and a back wall wherein the top, back and bottom walls form a continuous surface from the upper front edge to the lower leading front edge;

the walls having inner surfaces and outer surfaces with said walls combined inner surfaces defining a material container;

the bucket attachment comprising at least two hook arms, the hook arms being attached to the upper front edge of the bucket and extend around the outer surfaces of the top and back walls, a support plate attached across the hook arms and extending substantially parallel to the back wall of the bucket, at least two fork members substantially perpendicularly attached to the support plate and extending away from the back wall outer surface; and, a support web extending from the support plate and under each respective fork member for the support of said respective fork member.

* * * * *